US009138631B2

(12) United States Patent
Scholl

(10) Patent No.: US 9,138,631 B2
(45) Date of Patent: Sep. 22, 2015

(54) HARNESS FOR SKIS

(71) Applicant: Zombie Ski Harness, LLC, Huntsville, AL (US)

(72) Inventor: Brian Scholl, Huntsville, AL (US)

(73) Assignee: Zombie Ski Harness, LLC, Huntsville, AL (US)

( * ) Notice: Subject to any disclaimer, the term of this patent is extended or adjusted under 35 U.S.C. 154(b) by 57 days.

(21) Appl. No.: 14/192,267

(22) Filed: Feb. 27, 2014

(65) Prior Publication Data

US 2014/0239033 A1 Aug. 28, 2014

Related U.S. Application Data

(60) Provisional application No. 61/770,191, filed on Feb. 27, 2013.

(51) Int. Cl.

| | |
|---|---|
| ***A45F 3/04*** | (2006.01) |
| ***A63C 11/02*** | (2006.01) |
| ***A45F 3/14*** | (2006.01) |

(52) U.S. Cl.

CPC ..... *A63C 11/025* (2013.01); *A45F 3/14* (2013.01); *A45F 3/04* (2013.01); *A45F 2003/146* (2013.01); *Y10S 224/917* (2013.01)

(58) Field of Classification Search

CPC ..... A45F 3/04; A45F 3/14; A63C 11/025; Y10S 224/917

USPC ..... 224/917, 149, 913

See application file for complete search history.

(56) References Cited

U.S. PATENT DOCUMENTS

| | | | | | |
|---|---|---|---|---|---|
| 2,224,568 | A | | 12/1940 | Altorfer | |
| 4,518,107 | A | | 5/1985 | Amos | |
| 4,673,118 | A | | 6/1987 | Kronz | |
| 4,819,845 | A | | 4/1989 | Byrd | |
| 4,858,797 | A | * | 8/1989 | Rabska | 224/162 |
| 5,323,942 | A | * | 6/1994 | Dahan | 224/639 |
| 5,341,973 | A | * | 8/1994 | Dawes et al. | 224/196 |
| D352,603 | S | | 11/1994 | Maller | |
| 5,746,361 | A | * | 5/1998 | Johnson | 224/258 |
| 5,779,036 | A | | 7/1998 | Westbrook et al. | |
| 5,803,332 | A | | 9/1998 | Thompson | |

(Continued)

FOREIGN PATENT DOCUMENTS

| | | | |
|---|---|---|---|
| DE | 202013000370 U1 | * | 3/2013 |
| EP | 1707247 A1 | * | 10/2006 |

*Primary Examiner* — Justin Larson

(74) *Attorney, Agent, or Firm* — Angela Holt; Frank M. Caprio; Bradley Arant Boult Cummings LLP

(57) ABSTRACT

A ski harness has a back panel with connected shoulder straps that a person wears. A flap is connected to the bottom edge of the back panel, and to left and right pocket points on the back panel sides near the bottom edge, so the bottom portions of the flap and back panel form a pocket. The flap extends upward beyond the pocket points, but is not connected to the back panel above the pocket points, so the flap can fall away from the back panel. A release strap is connected to the top edge of the flap and to the user's shoulder straps to hold the flap against the back panel, and the release strap has a quick release fastener. Skis can be placed between the flap and back panel such that the bottoms of the skis are in the pocket, and the release strap holds the middle of the skis against the back panel and within the ski harness. The skis can be quickly released and dropped by unbuckling the quick release fastener on the release strap.

17 Claims, 4 Drawing Sheets

(56) References Cited

U.S. PATENT DOCUMENTS

| | | | | |
|---|---|---|---|---|
| 5,934,533 | A * | 8/1999 | Callanan | 224/651 |
| 5,975,393 | A * | 11/1999 | Bellamy | 224/655 |
| 6,010,051 | A * | 1/2000 | Callanan | 224/651 |
| 6,863,201 | B2 * | 3/2005 | Esqueda | 224/576 |
| 7,568,599 | B2 * | 8/2009 | Hall | 224/250 |
| 7,575,138 | B2 | 8/2009 | Lindberg | |
| 7,712,645 | B2 * | 5/2010 | Calkin | 224/649 |
| 7,735,701 | B2 * | 6/2010 | Eberle | 224/149 |
| 7,971,764 | B2 | 7/2011 | Sabbah | |
| 8,584,917 | B2 * | 11/2013 | Hexels | 224/637 |
| 2003/0173382 | A1 | 9/2003 | Robinson | |
| 2005/0040199 | A1 | 2/2005 | Lemens et al. | |
| 2005/0067450 | A1 | 3/2005 | Trejo et al. | |
| 2005/0184118 | A1 * | 8/2005 | Vella | 224/625 |
| 2007/0051761 | A1 | 3/2007 | McNeal | |
| 2009/0145787 | A1 * | 6/2009 | Grander | 206/315.6 |
| 2009/0206118 | A1 * | 8/2009 | Sabbah | 224/652 |
| 2011/0180575 | A1 | 7/2011 | Abramowitz et al. | |
| 2012/0018478 | A1 * | 1/2012 | Hanna et al. | 224/600 |
| 2012/0292353 | A1 * | 11/2012 | Andersen | 224/149 |
| 2014/0239033 | A1 * | 8/2014 | Scholl | 224/645 |

* cited by examiner

HARNESS FOR SKIS

REFERENCE TO RELATED APPLICATIONS

This application claims the benefit of U.S. Provisional Application No. 61/770,191 titled "Harness for Skis," filed on Feb. 27, 2013, the entire contents of which are incorporated herein by reference.

BACKGROUND

1. Field of the Invention

This invention relates to harnesses used for carrying skis on a person's back.

2. Description of the Related Art

Many people enjoy skiing, and family vacations are often planned around skiing destinations. Parents often bring their children along, and the entire family will spend the day at a ski resort. The family will often park the car in a parking area, pick up their skis, poles, and other equipment, and begin the hike up to the ticket booth, the lodge, and the lifts. The hike from the car to the lifts can be fairly lengthy, and the task of carrying skis can be cumbersome, especially for small children.

People have to remove their skis and carry them once they reach the ski mountain as well. For example, a skier may remove their skis and carry them when taking a break at a ski lodge, or when boarding a gondola or tram. A skier may remove and carry their skis to access a good view, or after realizing they have started down the wrong trail. People also have to carry skies at locations other than the ski resort, such as at a hotel, boarding a transport bus, or even simply moving the skis around their house.

Skis are designed for skiing, and not for carrying. Skis tend to be long, fairly heavy, and the attached bindings can be awkward. Skis often split or come apart into two separate items to carry, which makes them more awkward and difficult to manage. These issues can be particularly difficult for children who are not accustomed to carrying and managing loads. Also, the relative weight and size of the skis can be more significant for a child than for a full grown adult.

After carrying skis to a desired location, such as near a lift, the user often wants to quickly put the skis down and start skiing, or quickly put the skis in a rack and go to some other activity. The user also wants to be able to quickly pick up the skis and load them for carrying, so a ski harness or carrying pack should be nearly as easy to load and unload as a person' arms. The user can always just pick up the skis and carry them, but a harness that is quick and simple to load and unload, and that makes it easier to carry the skis, can be a benefit to a skier. Such a harness can be especially beneficial to children, because it simplifies the process of carrying the skis to where they are needed, and happy children tends to make for happy parents. Many packs and other devices currently used to carry skis are designed to securely hold the skis, but the insertion and removal of the skis from the pack is notably slower than simply picking up or putting down a pair of skis carried in the user's arms.

BRIEF SUMMARY OF THE INVENTION

A ski harness has a back panel for placement next to a person's back. A flap is connected to the bottom end of the back panel, and extends upward to near the top end of the back panel. The flap is connected to the bottom end of the back panel, and also connected to the back panel at left and right pocket points located on the left and right side of the back panel. The left and right pocket points are relatively close to the bottom end of the back panel, and the connections at the left and right pocket points and the bottom end form a pocket between the back panel and the flap. The pocket is primarily open from the top to accept the skis, and the flap above the pocket points is not connected to the back panel so it can fall away.

The ski harness has left and right shoulder straps connected to the back panel. At least one release strap is connected to the top edge of the flap and to one of the shoulder straps, and the release strap has a quick release fastener so the user can quickly connect or separate the release strap. The release strap is used to secure the flap against the back panel when skis are in the harness, and the flap falls away from the back panel and releases the skis when the fastener on the release strap is separated.

DETAILED DESCRIPTION

Ski Harness Back Panel

Figure 1:
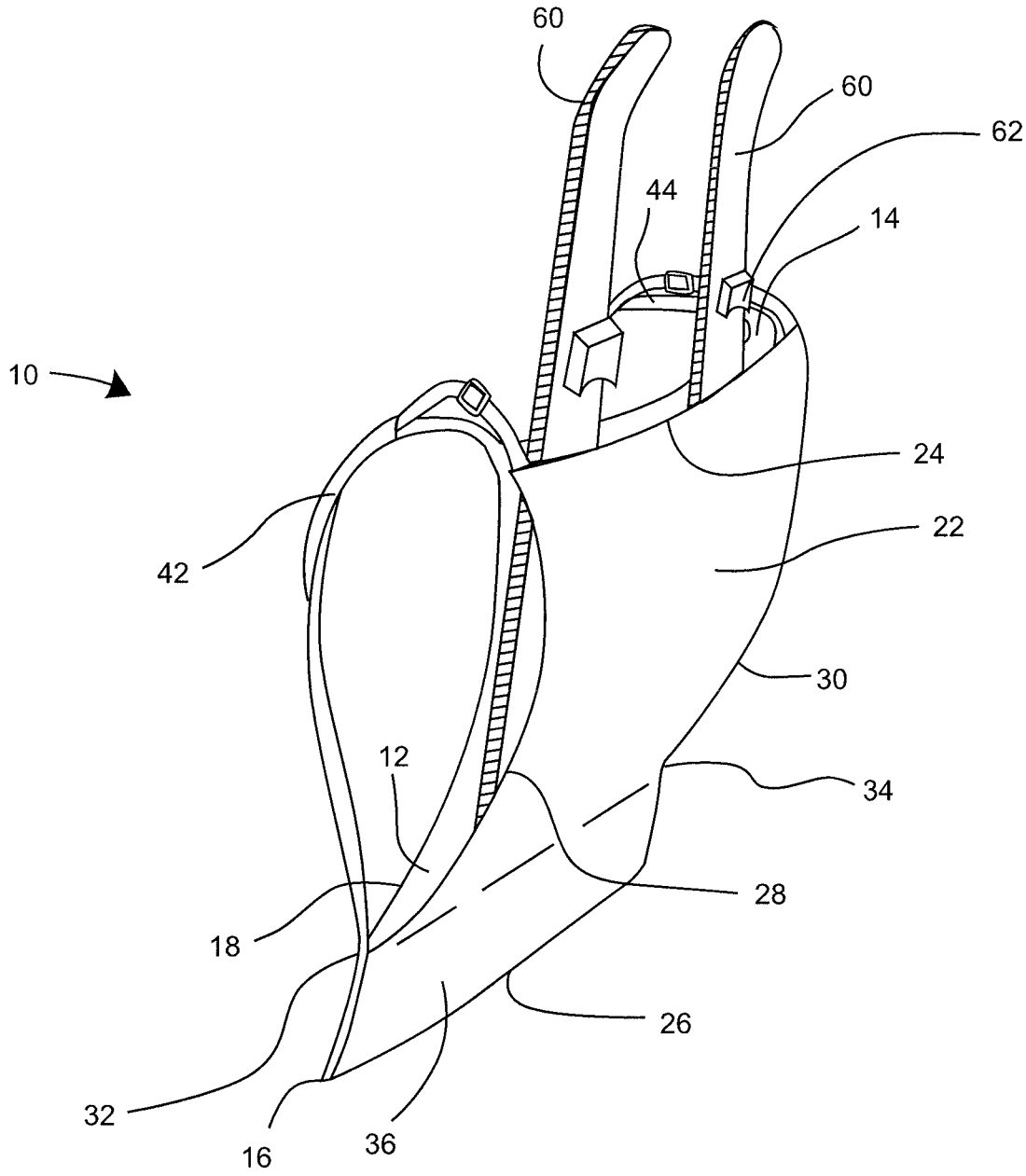
FIG. 1 is a rear perspective view of a ski harness with skis, according to an exemplary embodiment of the present disclosure.
Figure 2:
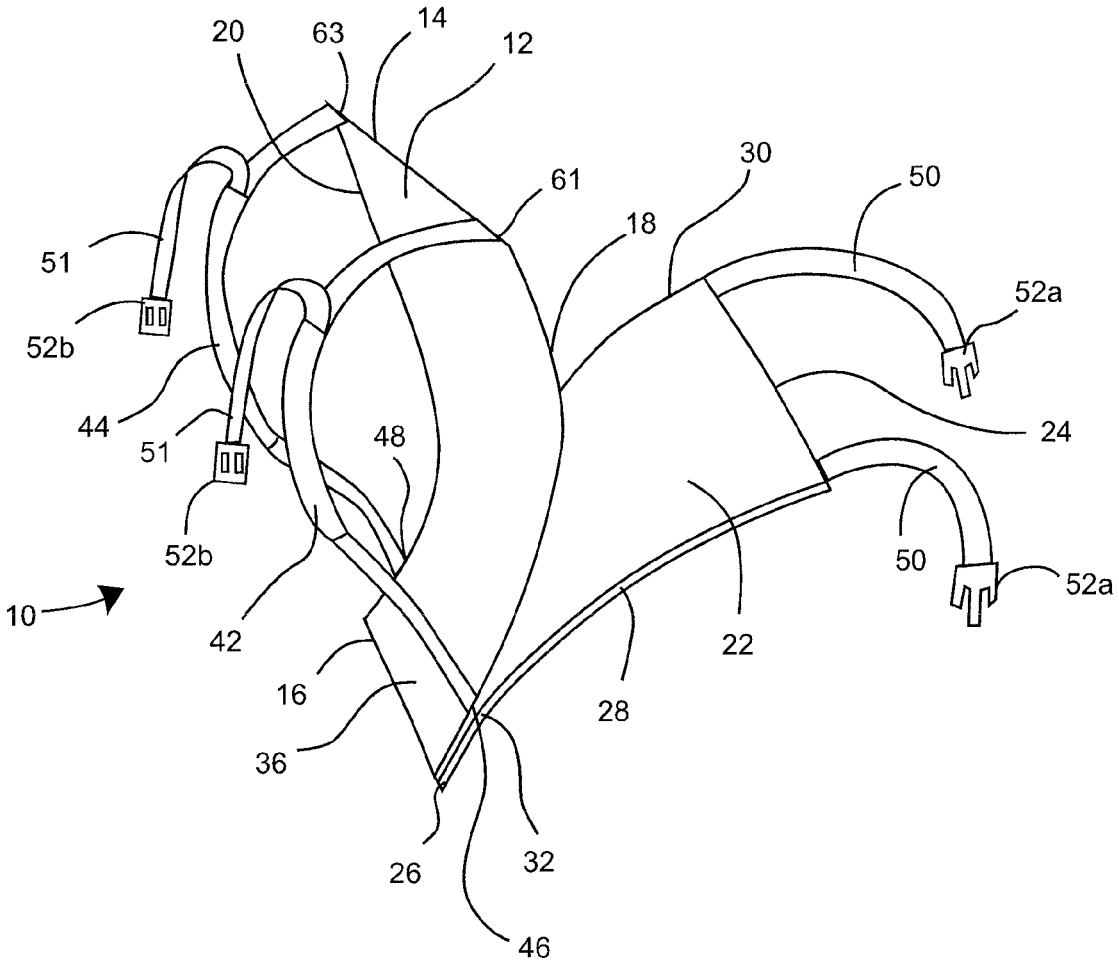
FIG. 2 is a rear perspective view of the ski harness of FIG. 1 without the skis and with the flap open.

FIG. 1 is a rear perspective view of a ski harness 10 according to an exemplary embodiment of the present disclosure. The ski harness 10 supports skis 60 on a user's back (not shown). The ski harness 10 has a back panel 12, and the back panel 12 has a top end 14, a bottom end 16, a panel left side 18, and a panel right side 20 (FIG. 2). The ski harness 10 is generally sized and shaped to match a user's back. The ends 14 and 16 and sides 18 and 20 may not be straight in some embodiments, and can have an arched shape, a curved shape, a jagged or angled shape, or other shapes. However, in the illustrated embodiments, the ends 14 and 16 and sides 18 and 20 are generally straight.

A person's back has roughly a quadrilateral shape defined by the shoulders, sides, and waist. The back panel 12 is designed to approximate this shape, so the back panel 12 generally has a quadrilateral shape. The panel top end 14 may be wider than the panel bottom end 16, because many people are wider at the shoulder than at the waist, but other sizes and shapes are also possible. Different sizes of ski harnesses 10 can be used for different people, and the ski harness 10 can be especially useful for children who may have more difficulty carrying a pair of skis 60 than many adults. Therefore, the size of the back panel 12 can be varied for different users, with some sizes geared for children and other sizes geared for adults.

The back panel 12 is sized such that it does not hang down below a user's derriere, so the user can sit down when skis 60 are in the ski harness 10. The bottom (not shown) of the skis 60 are positioned near the panel bottom end 16 when in place, so a back panel 12 that ends above the position of a chair seat when the user wearing the ski harness 10 is seated can prevent interference with seating. Therefore, in many embodiments, the back panel 12 is no longer than the distance between the base of a user's neck and the top of the user's thighs, and this distance can vary for different sized people. For example, a back panel 12 may be no more than twenty five inches from top to bottom for an adult, and a back panel 12 for a child may be no more twenty inches, or sixteen inches, or other lengths from top to bottom depending on the size of the child.

The back panel 12 may be flexible so it can mold and conform to the user's back when worn, similar to a back pack or day pack. The back panel 12 can be solid, such as a single sheet of fabric, but the back panel 12 can also be a mesh material, or even a simple framework of webbing or other material that form the panel's top end 14, bottom end 16, left side 18, and right side 20. The back panel 12 provides a base for securing the ski harness 10 to the user's back, and many different structures or styles can be used. The back panel 12 can be made of a wide variety of different types of fabric, such as cotton, wool, nylon, polyester, silk or other materials. It could also include padding to ease the pressure from the skis on the user's back. Some embodiments could include a simple frame to provide a more ridged structure, but many embodiments have no frame so the entire back panel 12 and ski harness 10 are soft and flexible. The frame could be metallic, polymeric, wood, or other materials, if present, as long as it provides the structure desired. Embodiments without a frame can be useful because the entire ski harness 10 can be folded up or stuffed into a small space, and then retrieved and worn when desired.

The Flap

A flap 22 retains the skis 60 in place within the ski harness 10. The flap 22 has a flap top edge 24 and a flap bottom edge 26, as well as a flap left side 28 and a flap right side 30. In many embodiments, the flap top edge 24, bottom edge 26, left side 28, and right side 30 are close in size and shape to the corresponding panel top end 14, bottom end 16, left side 18, and right side 20, such that the flap 22 and back panel 12 are approximately the same size and shape. The flap 22, like the back panel 12, can be a solid material, or a mesh, a simple webbing frame defining the edges, or other configurations, as desired. The materials of construction can also be similar for the flap 22 and for the back panel 12.

The flap 22 is connected to the back panel 12 at the back panel bottom end 16, which is also at the flap bottom edge 26. The flap 22 and the back panel 12 can be a single piece of material that forms a crease or bend at the panel bottom end 16, or it can be two separate pieces of material that are joined at the panel bottom end 16, as desired. The connection between the panel bottom end 16 and the flap bottom edge 26 can be a continuous connection, but it can also be an intermittent connection, as desired. A continuous connection may be easier to manufacture, and it may be stronger, but an intermittent connection may allow for snow or other debris to fall through the connection and prevent unwanted accumulation between the flap 22 and back panel 12. If the connection between the flap 22 and back panel 12 is intermittent, the connection points should be spaced close enough that a ski 60 cannot fit between adjacent connection points. This connection, whether continuous or intermittent, needs to be strong enough to support a ski 60, including supporting a ski 60 well enough that children's natural rough housing will not cause the ski 60 to break the connection.

The flap 22 is also connected to the back panel 12 along the left sides 18 and 28 at a left pocket point 32, and along the right sides 20 and 30 at a right pocket point 34. The left and right pocket points 32 and 34 are places where the flap 22 and back panel 12 are stitched or otherwise secured together. The connections between the flap 22 and back panel 12 along the bottom end 16 and the left and right pocket points 32 and 34 forms a pocket 36 that releasably retains the bottom of the skis 60 in the ski harness 10. The pocket 36 is open along its top (not shown) to accept the skis 60, and the connections at the pocket points 32 and 34 prevent the bottom of the skis 60 from slipping out from the sides of the ski harness 10. The flap 22 and back panel 12 can be continuously connected along the left sides 18 and 28 between the bottom end 16 and the left pocket point 32, with a similar connection along the right sides 20 and 30, such that the pocket 36 is sealed all along its side. However, in other embodiments, the flap 22 and back panel 12 can be open between the bottom end 16 and the pocket points 32 and 34, or intermittently connected, such that snow or other debris can fall out of the side of the pocket 36. The pocket points 32 and 34 form the sides of the pocket 36 regardless of the continuous or intermittent nature of the connection of the flap 22 and back panel 12 along the sides 18, 20, 28, and 30.

The pocket points 32 and 34 should be relatively close to the bottom end 16, so the pocket 36 is not very deep. In some embodiments, the pocket 36 is no more than seven inches deep, which means the pocket points 32 and 34 are no more than seven inches above the panel bottom end 16 and the flap bottom edge 26. A person wearing the ski harness 10 with skis 60 in it can shake and twist, and the connections between the flap 22 and back panel 12 at the pocket points 32 and 34 prevent the bottom of the skis 60 from slipping out of the ski harness 10. Gravity urges the skis 60 into the pocket 36, which holds in skis 60 in place. In alternate embodiments, the pocket points 32 and 34 are no more than four inches above the bottom end 16, and in other embodiments, the pocket points 32 and 34 are no more than two inches above the bottom end 16.

There can be an additional central pocket point 38 (FIG. 3) positioned approximately half way between the left and right pocket points 32 and 34. The central pocket point 38 connects the back panel 12 to the flap 22, and can separate the two skis 60, so each ski 60 effectively has its own pocket 36. The ski harness 10 is effective with or without the optional central pocket point 38.

In the embodiment of FIG. 1, the flap 22 is not connected to the back panel 12 above the pocket points 32 and 34, so the flap 22 can fall away from the back panel 12. When the flap 22 falls away from the back panel 12, the skis 60 are only held upright by the short pocket 36. The pocket 36 is somewhat flexible, and the skis 60 will extend significantly above the pocket 36, so the skis 60 will generally fall out of the harness when the flap 22 falls away from the back panel 12. This makes for a rapid release of the skis 60 when desired. The flap 22 extends to approximately the same point as the back panel 12, so the flap top edge 24 is within six inches of the back panel top end 14, or more preferably within three inches of the back panel top end 14. When the flap 12 is secured against the back panel 24, a substantial portion of the skis 60 are held against the user's back, which secures the skis 60 within the ski harness 10.

Shoulder Straps

Shoulder straps 42 and 44 are used to hold the back panel 12 onto the user's back. A left shoulder strap 42 and a right shoulder strap 44 are connected to the back panel 12 at the left back panel top corner and the right back panel top corner, respectively.

FIG. 2 is a perspective view of the ski harness of FIG. 1 with the flap 22 partially opened. The left shoulder strap 42 is connected to the back panel 12 at a left upper corner 61 and extends between the left upper corner 61 and a left shoulder strap lower connection point 46 which is below the panel top end 14. The right shoulder strap 44 is connected to the back panel 12 at a right upper corner 63 and extends between the right upper corner 63 and a right shoulder strap lower connection point 48 below the panel top end 14, in a manner similar to many back packs or day packs. The shoulder strap lower connection points 46 and 48 are preferably at the panel left and right sides 18, 20, but other locations are also possible.

In some embodiments, the shoulder strap lower connection points 46 and 48 are at the left and right pocket points 32 and 34. The ski harness 10 tends to pivot at the pocket points 32 and 34 as the skis 60 fall out of the ski harness 10 when the flap 22 falls away from the back panel 12. In many traditional day packs or back packs, the shoulder straps are connected at or near the bottom of the pack. However, positioning the shoulder strap lower connection points 46 and 48 at or above the pocket points 32 and 34 facilitates the pivot action when the skis 60 are released, because this design leaves the entire pocket 36 hanging free. The free hanging pocket 36 is able to twist and bend below the support provided by the lower shoulder strap connection points 46 and 48, so the skis 60 fall out without disturbing the back panel 12 between the shoulder strap connection points. In other embodiments, the shoulder strap lower connection points 46 and 48 are at the panel bottom end 16 or between the panel bottom end 16 and the pocket points 32 and 34, or above the pocket points 32 and 34.

The shoulder straps 42 and 44 comprise padding in some embodiments. In other embodiments, a chest strap (not shown) releasably connects the left and right shoulder straps 42 and 44 to further support the back panel 12. The shoulder straps 42 and 44 can comprise a sliplock fastener or other device to adjust the length of the shoulder straps. There can be clips, snaps, or other devices such that the shoulder straps 42 and 44 can be detached and re-attached to the back panel 12, and many other designs and features can be incorporated similar to day packs and back packs. The ski harness 10 can also comprise a belt (not shown) in some embodiments. The belt can include many variations and design features, similar to day packs and back packs.

In other embodiments, the shoulder straps 42 and 44 and the back panel 12 can be integrated such that the back panel 12 and shoulder straps 42 and 44 are a vest, or even a jacket with sleeves. A basic function of the back panel 12 and shoulder straps 42 and 44 is to provide a mount for the flap 22, so shapes and designs that appear different than a day pack are possible. If the ski harness 10 comprises a vest or jacket, the distinction between the portions of the ski harness 10 referenced in this description as the back panel 12 and shoulder straps 42 may not be clear, but the basic function remains. There is (a) material that passes over the user's shoulders to support the flap 22, pocket 36 and skis 60, and (b) a framework such that the flap 22 can be secured against the user's back and the entire ski harness 10 can be worn while the user moves about.

Release Straps

Release straps 50 and 51 are used to secure the flap top edge 24 near the back panel top end 14. In this regard, the release strap 50 is connected to the flap 22 at a point on or somewhere near the flap top edge 24, and the release strap 51 is connected on or near the back panel 12. The release strap 50 is releasably mated to the release strap 51 to hold the flap 22 in place near the back panel 12. The release strap 50 is preferably secured to a shoulder strap 42 or 44, so the release strap 50 extends from the flap top edge 24 over the user's shoulder to the shoulder strap 42 or 44. The release strap 50 can comprise a quick release fastener 52*a* that mates with a quick release fastener 52*b* on the release strap 51 to allow the user to quickly disconnect or re-connect the release strap 50 to the release strap 51. When the release strap 50 is connected to the release strap 51, the quick release fastener 52 is generally positioned on the front of the user's shoulder for easy access. In alternate embodiments, the release straps 50 and 51 can be connected to the back panel 12, a chest strap, a belt, or some other component of the ski harness 10 that allows the flap 22 to be drawn up against the back panel 12.

In the illustrated embodiments, the ski harness 10 comprises two release straps 50 and 51, one on each side. Release straps 50 are positioned at the flap left and right corners of the top edge 24 and release straps 51 are positioned at the shoulder straps 42 and 44. The quick release fasteners 52*a* and 52*b* can then be positioned close to the right shoulder strap 44, so the fasteners 52*a* and 52*b* are on the user's chest in an easy to access location. The two release straps 50 and 51 hold up both sides of the flap 22, and also pass around the sides of the skis 60 at least somewhat close to the skis' center. In this manner, the two straps 50 assist in retaining the skis 60 within the ski harness 10, so the lower portion of the skis 60 are secured by the pocket 36 and a central portion of the skis 60 are held within the ski harness 10 by the release straps 50 and/or the flap 22.

When the release straps 50 are separated at the quick release fastener 52, the top of the skis 60 are no longer held in place and the skis 60 will fall out of the ski harness 10 as the flap 22 falls away from the back panel 12. The release strap 50 can be connected to locations other than the shoulder straps 42 and 44 and still hold the skis 60 in place, as mentioned above. In some embodiments, the quick release fastener 52 allows the user to connect either release strap 50 or 51 to either shoulder strap 42 or 44, so different users can utilize different methods of securing the skis 60 in place.

The release straps 50 and 51 can be adjustable in length. A length adjustment can be incorporated into the quick release fastener 52*a* and 52*b* design, or a separate length adjustment device can be used, such as a sliplock fastener. The release straps 50 and 51 can be re-connected after the skis 60 are removed from the ski harness 10 so there are no loose flaps or straps hanging off the user when skiing. The user can then wear the ski harness 10 all day while skiing, or remove the ski harness 10 after use and stuff it into a storage pouch or other location, as desired. The skis 60 typically comprise bindings 62 (FIG. 1), and the adjustable length and soft nature of the ski harness 10 and release straps 50 allows the user to accommodate a wide variety of ski 60 and binding 62 designs and sizes without difficulty.

Figure 3:
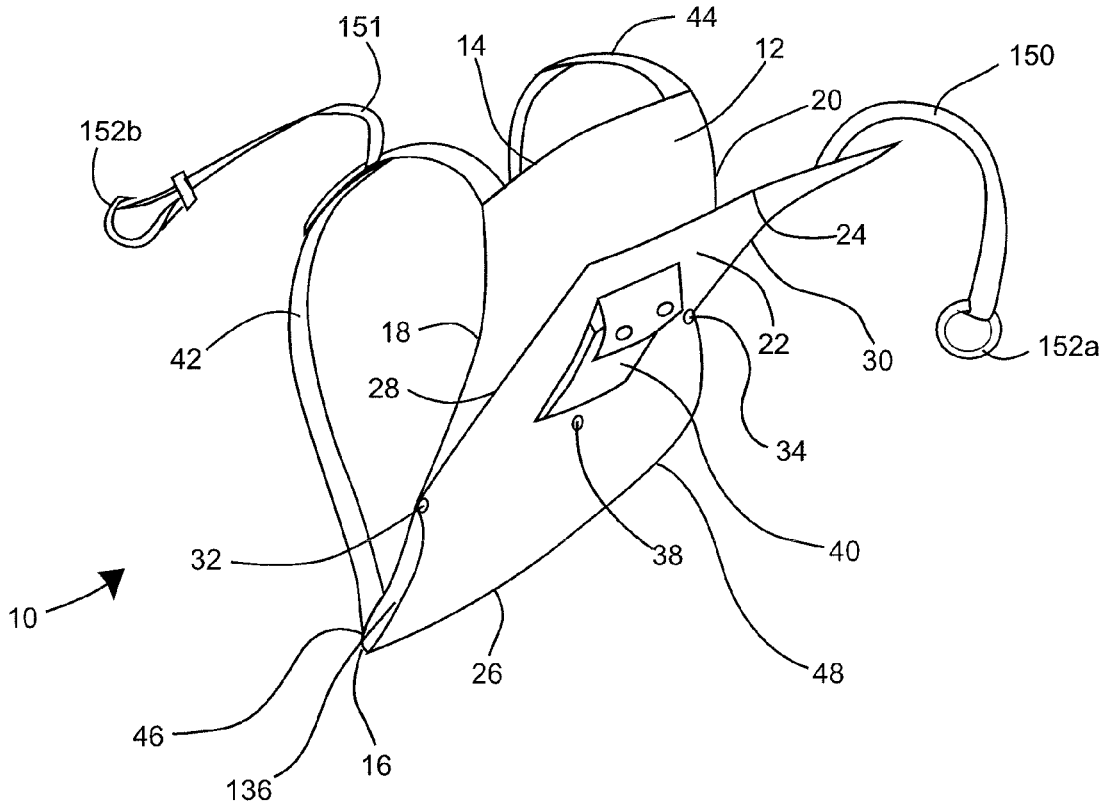
FIG. 3 is a perspective view of still another embodiment of the ski harness with a single release strap, and with a pouch attached to the flap.

FIG. 3 is a perspective view of another embodiment of the ski harness. In this embodiment release straps 150 and 151 join together to form one strap instead of the pair of straps in the earlier-described embodiments. In this embodiment, a release strap 150 is connected near the upper right corner of the flap 22 and a release strap 151 is connected to the shoulder strap 42. Fastener 152*a* on release strap 150 releasably mates with fastener 152*b* on release strap 151.

In this embodiment, the flap 22 is connected to the back panel 12 along the back panel bottom end 16, at the pocket points 32 and 34 along the back panel sides, and at a central pocket point 38. The spaces 136 between the pocket points 32 and 34 on the sides of the back panel and the bottom end 16 are open.

The flap 22 in this embodiment includes a pouch 40 for storing gear (not shown), such as a hat, gloves, extra money, or anything that will fit in a pouch 40. A pouch 40 can also be positioned on other portions of the ski harness 10, but the flap 22 is a convenient position. In some embodiments, there is no pouch 40 on the ski harness 10, which minimizes weight and bulk, but in other embodiments, the ski harness 10 does include a pouch 40 for convenient storage. The pouch 40 can be many different shapes and sizes, and it can have zippers, hook and loop fasteners, or other features as desired.

Figure 4:
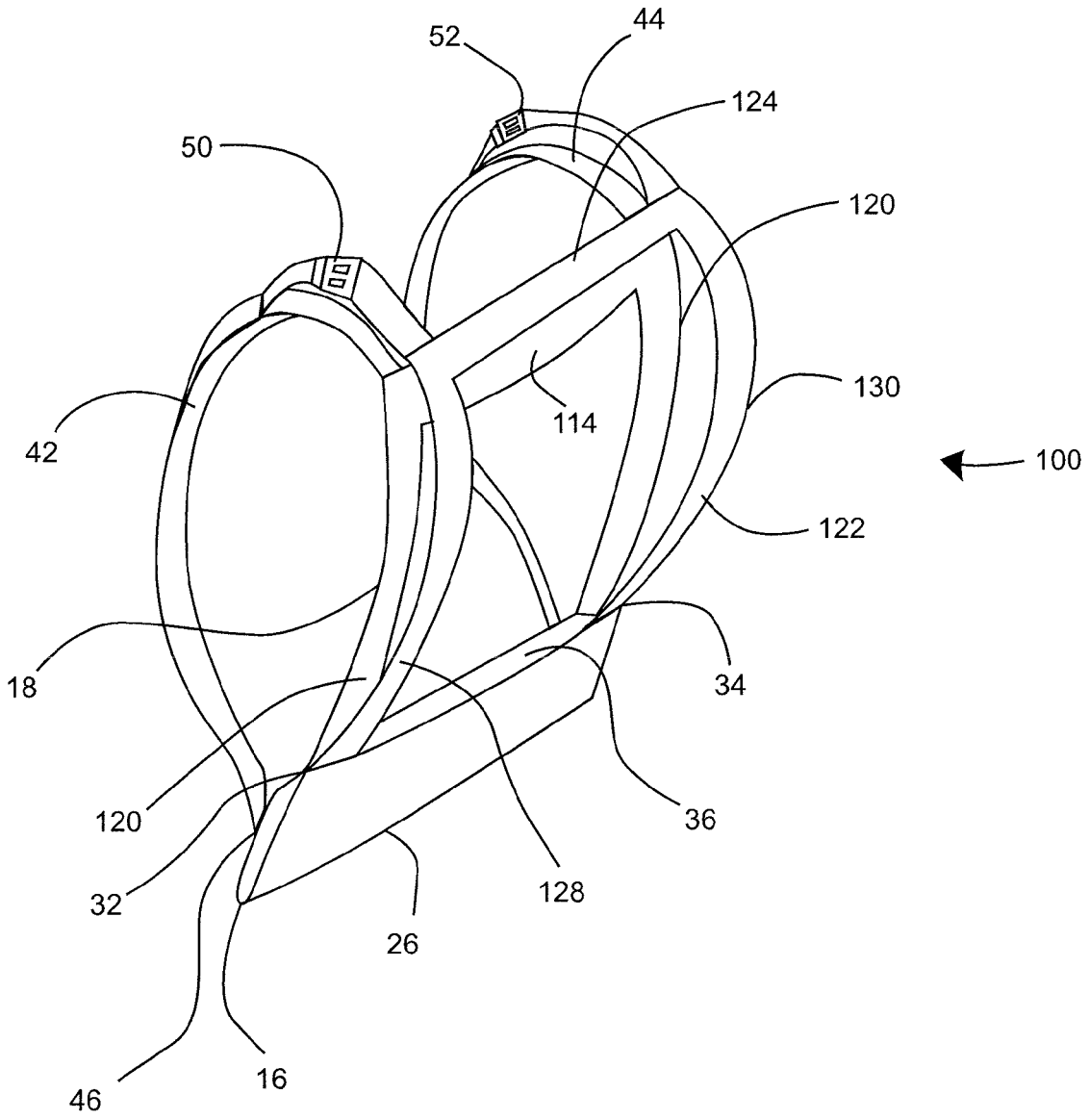
FIG. 4 is a perspective view of another embodiment of the ski harness, where the back panel and the flap are formed from strips instead of solid pieces.

FIG. 4 depicts an alternative embodiment of the ski harness 100 in which portions of the back panel 120 and the flap 122 are formed from strips instead of solid materials. Such a configuration may be desired to reduce the weight of the ski harness 100. In this embodiment, the back panel 120 above the pocket 36 is formed from vertical strips 118 and 120 on opposed sides and a horizontal strip 124 that extends between and connects vertical strip 118 to vertical strip 120. Similarly, the flap 122 above the pocket 36 is formed from vertical strips 128 and 130 on opposed sides and a horizontal strip 124 that extends between and connects the vertical strip 128 to the vertical strip 130.

The invention claimed is:

1. A ski harness comprising:

a back panel having a top end, a bottom end, a left side, and a right side;

a flap connected to the back panel at the bottom end of the back panel, the flap also connected to the back panel at a left and right pocket point, the left and right pocket points positioned along the back panel left and right sides at a point within seven inches of the back panel bottom end, wherein the flap is connected to the back panel along the entire distance between the left pocket point and the back panel bottom end and along the entire distance between the right pocket point and the back panel bottom end;

a right shoulder strap connected to the back panel top right corner and to the back panel at a point below the back panel top right corner;

a left shoulder strap connected to the back panel top left corner and to the back panel at a point below the back panel top left corner;

a release strap connected to the flap top edge and to at least one of the left and right shoulder straps, where the release strap further comprises a quick release fastener.

2. The ski harness of claim 1 where the release strap further comprises a first release strap and a second release strap, the first release strap extending between and releasably connecting an upper right corner of the flap to an upper right corner of the back panel and the second release strap extending between and releasably connecting an upper left corner of the flap to an upper left corner of the back panel.

3. The ski harness of claim 1 where left shoulder strap connects to the back panel at the left pocket point and the right shoulder strap connects to the back panel at the right pocket point.

4. The ski harness of claim 1 where the ski harness does not comprise a metallic frame.

5. The ski harness of claim 1, further comprising a central pocket point disposed between the right pocket point and the left pocket point.

6. The ski harness of claim 1 where the flap has a top edge that extends to within six inches of the back panel top end.

7. The ski harness of claim 1, further comprising a chest strap extending between and releasably connecting the right shoulder strap to the left shoulder strap.

8. A ski harness comprising:

a back panel having a top end, a bottom end, a left side, and a right side;

a flap connected to the back panel at the bottom end of the back panel, the flap also connected to the back panel at a left and right pocket point, the left and right pocket points positioned along the back panel left and right sides, wherein the flap is connected to the back panel along the entire distance between the left pocket point and the back panel bottom end and along the entire distance between the right pocket point and the back panel bottom end;

a right shoulder strap connected to the back panel in at least two places;

a left shoulder strap connected to the back panel in at least two places;

a release strap connected to the flap and to at least one of the left and right shoulder straps, where the release strap further comprises a quick release fastener.

9. The ski harness of claim 8, the left and right pocket points positioned along the back panel left and right sides at a point within seven inches of the back panel bottom end.

10. The ski harness of claim 8 where the release strap further comprises a first release strap and a second release strap, the first release strap extending between and releasably connecting an upper right corner of the flap to an upper right corner of the back panel and the second release strap extending between and releasably connecting an upper left corner of the flap to an upper left corner of the back panel.

11. The ski harness of claim 8 wherein the left shoulder strap is connected to the back panel at a top left corner and the left shoulder strap extends between the top left corner and the left pocket point and the right shoulder strap is connected to the back panel at a top right corner and the right shoulder strap extends between the top right corner and the right pocket point.

12. The ski harness of claim 8, further comprising a central pocket point disposed between the right pocket point and the left pocket point.

13. The ski harness of claim 8 where the flap has a top edge that extends to within six inches of the back panel top end.

14. A ski harness comprising:

a back panel having a top end, a bottom end, a left side, and a right side;

a flap connected to the back panel at the bottom end of the back panel, the flap also connected to the back panel at at least a left and right pocket point, the left and right pocket points positioned along the back panel left and right sides, at a position less than halfway up the left and right sides, wherein the flap is connected to the back panel along the entire distance between the left pocket point and the back panel bottom end and along the entire distance between the right pocket point and the back panel bottom end;

a right shoulder strap connected to the back panel;

a left shoulder strap connected to the back panel;

a release strap connected to the flap and to at least one of the left and right shoulder straps, where the release strap further comprises a quick release fastener.

15. The ski harness of claim 14 where the release strap further comprises a first release strap and a second release strap, the first release strap extending between and releasably connecting an upper right corner of the flap to an upper right corner of the back panel and the second release strap extending between and releasably connecting an upper left corner of the flap to an upper left corner of the back panel.

16. The ski harness of claim 14 wherein the left shoulder strap is connected to the back panel at a top left corner and the left shoulder strap extends between the top left corner and the left pocket point and the right shoulder strap is connected to the back panel at a top right corner and the right shoulder strap extends between the top right corner and the right pocket point.

17. The ski harness of claim 14, further comprising a central pocket point disposed between the right pocket point and the left pocket point.

* * * * *